US006715830B2

(12) United States Patent
Alexy

(10) Patent No.: US 6,715,830 B2
(45) Date of Patent: Apr. 6, 2004

(54) CHILD RESTRAINT SYSTEM FOR USE IN WATERCRAFT

(75) Inventor: Grayson L. Alexy, Euclid, OH (US)

(73) Assignee: Sea Seat, Inc., Euclid, OH (US)

( * ) Notice: Subject to any disclaimer, the term of this patent is extended or adjusted under 35 U.S.C. 154(b) by 0 days.

(21) Appl. No.: 10/437,326

(22) Filed: May 13, 2003

(65) Prior Publication Data

US 2003/0189365 A1 Oct. 9, 2003

Related U.S. Application Data

(60) Provisional application No. 60/430,923, filed on Dec. 4, 2002.

(51) Int. Cl.[7] ..... A47D 1/10

(52) U.S. Cl. ..... 297/250.1; 297/256.1; 297/256.13; 441/80; 441/130

(58) Field of Search ..... 297/250.1, 217.1, 297/256.1, 256.13; 114/363; 441/80, 88, 130

(56) References Cited

U.S. PATENT DOCUMENTS

| | | | | |
|---|---|---|---|---|
| 1,639,607 A | | 8/1927 | Henry | |
| 2,350,679 A | | 6/1944 | Hann | |
| 2,623,574 A | | 12/1952 | Damsch | |
| 3,102,280 A | | 9/1963 | Williams | |
| 3,154,345 A | | 10/1964 | Lambrect | |
| 3,265,438 A | | 8/1966 | Regan et al. | |
| 3,565,486 A | | 2/1971 | Channon | |
| 3,620,570 A | | 11/1971 | Wilson et al. | |
| 3,740,095 A | | 6/1973 | Nail | |
| 4,179,158 A | | 12/1979 | Flaum et al. | |
| 4,441,221 A | | 4/1984 | Enste et al. | |
| 4,500,135 A | | 2/1985 | Kincheloe | |
| 4,601,667 A | | 7/1986 | Hull | |
| 4,606,728 A | | 8/1986 | Simpson | 297/255 X |
| 4,627,659 A | | 12/1986 | Hall | |
| 4,687,452 A | | 8/1987 | Hull | 297/250.1 X |
| 4,711,490 A | | 12/1987 | Brand | |
| 4,725,253 A | | 2/1988 | Politte | 441/130 |
| 4,798,551 A | | 1/1989 | Dumonceaux et al. | |
| 4,799,910 A | | 1/1989 | Kellough | |
| 4,837,869 A | | 6/1989 | Simmon | |
| 5,005,902 A | | 4/1991 | Farnworth et al. | |
| 5,143,420 A | | 9/1992 | Switlik | |
| 5,219,203 A | | 6/1993 | Switlik | |
| 5,224,891 A | | 7/1993 | Stephens | |
| 5,409,411 A | * | 4/1995 | Schreiber | 441/80 |
| 5,514,020 A | | 5/1996 | Gainforth | |
| 5,673,969 A | | 10/1997 | Frazier | 297/256.16 X |
| 6,033,029 A | | 3/2000 | Henshall | |
| 6,059,360 A | | 5/2000 | Bedard | 297/250.1 |
| 6,296,305 B1 | * | 10/2001 | Lamka et al. | 441/130 X |
| 6,394,867 B1 | | 5/2002 | Bianco | |
| 6,412,865 B1 | | 7/2002 | Bedard | 297/256.16 X |
| 6,428,099 B1 | * | 8/2002 | Kain | 297/256.13 X |
| 6,482,060 B1 | * | 11/2002 | Gorny et al. | 297/250.1 X |
| 6,589,089 B1 | * | 7/2003 | Glass et al. | 297/250.1 |
| 2002/0084680 A1 | * | 7/2002 | Kain | 297/256.13 |
| 2002/0195849 A1 | * | 12/2002 | Bedard | 297/250.1 |

* cited by examiner

*Primary Examiner*—Peter M. Cuomo
*Assistant Examiner*—Rodney B. White
(74) *Attorney, Agent, or Firm*—Pearne & Gordon LLP

(57) ABSTRACT

A child restraint system for securing a child aboard a watercraft, the child restraint system including a base to be secured to a fixture of the watercraft, a seat assembly adapted to be releasably coupled to the base in a manner to support the child in a seated position, a restraint for securing the child to the seat, a release mechanism that cooperates with the base and the bottom portion of the seat assembly when the seat assembly is coupled to the base, and a floatation device to float the child on a surface of water such that the head of the child is maintained above the surface of the water. The release mechanism automatically releases the child from the watercraft when a portion of the seat assembly is immersed in the water.

31 Claims, 3 Drawing Sheets

CHILD RESTRAINT SYSTEM FOR USE IN WATERCRAFT

This application claims the benefit of Provisional Application No. 60/430,903, filed Dec. 4, 2002.

FIELD OF THE INVENTION

The present invention relates generally to child restraints, and more particularly to a child safety seat to be used with a watercraft, the child safety seat being automatically releasable from the watercraft to float the child at a surface of the water.

BACKGROUND OF THE INVENTION

Children traveling in an automobile are required by law to be secured to a child safety seat to provide the child a degree of support and protection from injuries due to sudden changes of direction or an impact with another object. Child safety seats typically include a rigid seat coupled to a seat of the automobile by a base that is fixed to the seat by straps or other fasteners. Padding covers the interior surface of the seat upon which children sit to make the seat more comfortable. The seat is easily coupled to and removed from the base by using a quick release mechanism. Although adapted for use in an automobile, conventional child safety seats are not sufficiently buoyant to float a child secured thereto on water, and do not include ballast devices to maintain the child safety seat in an upright orientation in the water.

Similar seats to be used in a marine environment are known and generally include the conventional child safety seat used in automobiles fitted with a floatation device. These seats are used aboard watercraft in lieu of conventional personal floatation devices such as life vests because children in live vests must be supervised at all times by an adult. Further, the marine child safety seats protect children during operation of the watercraft from being thrown overboard or into an object, subjecting children to injury.

Marine child safety seats are generally coupled to a fixture of a watercraft with a base or straps, similar to those used to couple child safety seats to automobile seats. Like conventional automobile seats, an adult occupant of the watercraft must manually release the child safety seat from the fixture it is coupled to. If the watercraft is taking on water as a result of a collision with a foreign object and is threatening to sink, an adult incapacitated during the collision may not be able to release a child secured to a child safety seat. This creates the possibility that the child safety seat, along with the child, will go down with the watercraft. In fact, this is one reason why there has historically been a barrier to obtaining the approval of child safety seats for use in a marine environment by the U.S. Coast Guard.

Additional features included on child safety seats for use in marine environments often interfere with the use of the same child safety seat in an automobile. The floatation device, for example, is often a ring or other fixed shape structure formed from a buoyant material. These floatation devices are typically provided on the back-supporting portion of the conventional child safety seat for marine applications. In such a position, the floatation device requires a large area for installation of the child safety seat in automobiles that can have only a limited area available.

Accordingly, it would be beneficial to provide a child restraint system to be used aboard a watercraft that would not require adult intervention to release a child secured to the watercraft using the system in an emergency situation. Additionally, the system should maintain the child in an upright orientation while floating on the water and include features that maximize the chances that the child will be recovered safely.

SUMMARY OF THE INVENTION

In accordance with one aspect, the present invention provides a child restraint system for securing a child aboard a watercraft, the child restraint system including a base to be secured to a fixture of the watercraft, a seat assembly adapted to be releasably coupled to the base in a manner to support the child in a seated position, a restraint for securing the child to the seat, a release mechanism that cooperates with the base and the bottom portion of the seat assembly when the seat assembly is coupled to the base, and a floatation device to float the child on a surface of water such that the head of the child is maintained above the surface of the water. The release mechanism automatically releases the child from the watercraft when a portion of the seat assembly is immersed in the water.

In accordance with another aspect, the present invention includes a child seat to be coupled to a fixture of a watercraft for securing a child thereto, the seat including a bottom portion and a rear portion shaped to support a child in a seated position, a restraint for securing the child to the seat, a release mechanism for automatically releasing the child from the fixture when a portion of the seat is immersed in water, and a floatation device to float the child on the water when the child is released from the fixture such that the head of the child is maintained above the water.

BRIEF DESCRIPTION OF THE DRAWINGS

The foregoing and other features and advantages of the present invention will become apparent to those skilled in the art to which the present invention relates upon reading the following description with reference to the accompanying drawing, in which.

DETAILED DESCRIPTION OF AN EXAMPLE EMBODIMENT

Figure 1:
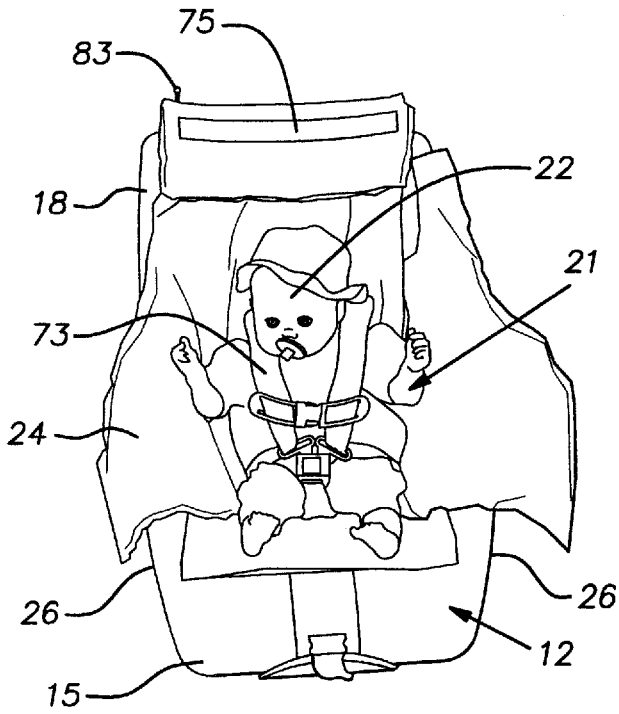
FIG. 1 is a front view of an example arrangement of a child seat assembly in accordance with the present invention having a child secured thereto.

Certain terminology is used herein for convenience only and is not to be taken as a limitation on the present invention.

Further, in the drawings, the same reference numerals are employed for designating the same elements throughout the figures, and in order to clearly and concisely illustrate the present invention, certain features may be shown in somewhat schematic form.

FIGS. 1–6 show an example embodiment of a child restraint system 10 having automatic release mechanisms 11 (FIG. 6) for use in a watercraft (not shown) according to the present invention. The system 10 includes a seat 12 removably secured to a base 14 that is to be fixed to a fixture of the watercraft. This "two-part" system 10 having a separate seat 12 and base 14 may include known construction used in child safety seats for use in automobiles, examples of which are shown and described in expired U.S. Pat. Nos. 4,345,791 to Bryans et al. and 4,306,749 to Deloustal. It should be appreciated, however, that any suitable construction can be used within the scope of the present invention.

In a release situation, a child 21 occupant of the seat 12 is in imminent danger of being submerged below a surface of the water, hereinafter referred to as the water level. The water level is generally an interface between the volume of standing water upon which the watercraft travels and the ambient air environment. According to this definition, the water level is not necessarily a planar surface, but may be variably amorphous due to disruptions such as waves and fluctuations in tide. Thus, the release situation may include situations such as a partial or complete submergence of the watercraft to a degree where the water level reaches the child restraint system 10. In a release situation, the child restraint system 10 effectuates the release of the child 21 occupant from the watercraft and the floatation of the child 21 such that the child's head 22 is substantially maintained at a position above the water level to allow the child 21 to adequately breathe.

The seat 12 includes a bottom portion 15 forming an angle with a rear, back-supporting portion 18 to create a suitably shaped seat 12 upon which a child 21 may sit. Any generally rigid material may be shaped into the bottom and rear portions 15, 18 of the seat 12. Examples of such materials include those that can be subjected to an aqueous environment with minimal degradation, such as plastics, corrosion resistant metals and alloys of each. Use of such materials in the construction of the bottom and rear portions 15, 18 maximizes the useful life of the seat 12 in conditions typically experienced by occupants of a watercraft. Rigid materials also provide a degree of protection for a child 21 secured to the seat 12. In an example embodiment where the seat 12 is formed from a plastic material, the seat 12 can be integrally formed as a single continuous unit having the bottom portion 15 molded to the rear portion 18 suitably shaped to support a child 21 in a seated position, or the rear portion 18 can be adjustable relative to the bottom portion 15. Alternatively, the seat 12 can be formed as separate constituent pieces fastened together in a known manner. Also, the seat 12, or its constituent pieces, can be manufactured according to any known method, such as injection molding, without departing from the scope of the present invention.

Padding 24 is disposed on surfaces of the rigid seat 12 that are adjacent to the child 21 when the child 21 is secured to the seat 12. The padding 24 provides comfort and protection to the child 21 while seated. According to the example embodiment of the present invention, at least a surface of the bottom portion 15 and a surface of the rear portion 18 that contact the child 21 secured to the seat 12 are padded. Other surfaces can also support the padding 24, such as inside surfaces of arm members 27 formed along laterally opposing sides 26 of the seat 12. These arm members 27 may provide the child 21 a degree of protection from objects that could potentially strike the child 21 from beside the seat 12 and provide lateral support to the child 21 during a sudden change in direction.

In order to minimize the absorption of water in the padding 24, thereby preventing the padding 24 from becoming waterlogged and weighing down the seat 12 when immersed in water, the padding 24 can be made from a non-porous material that will not readily absorb water. Such a material can also provide buoyancy to the seat 12 when immersion occurs. In the example embodiment of FIGS. 1–4, the padding 24 comprises an inherently buoyant material called kapok encased in a vinyl packet. Kapok is a natural fiber produced from the seeds of the kapok (or ceiba) tree. Other buoyant materials, such as closed-cell foams, and/or nonabsorbent materials, such as a vinyl encased cotton batting, or open cell foam, or a polymer gel, for example, can be included in the padding 24 without departing from the scope of the present invention. Alternatively, the padding 24 can be omitted entirely. Further, the seat 12 can be manufactured from a material that includes a padded feel yet is rigid enough to support an occupant of the seat 12.

Figure 2:
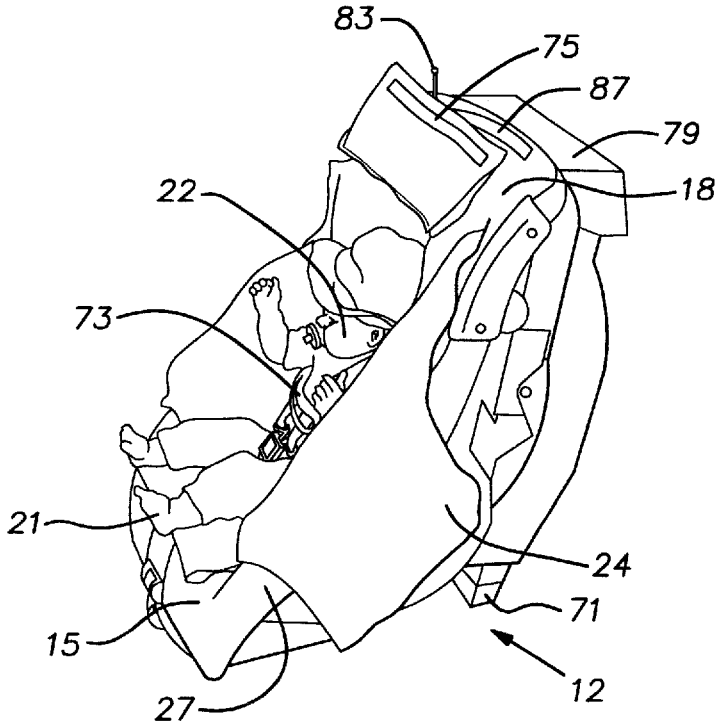
FIG. 2 is a perspective view of an example arrangement of a child seat assembly in accordance with the present invention having a child secured thereto.
Figure 3:
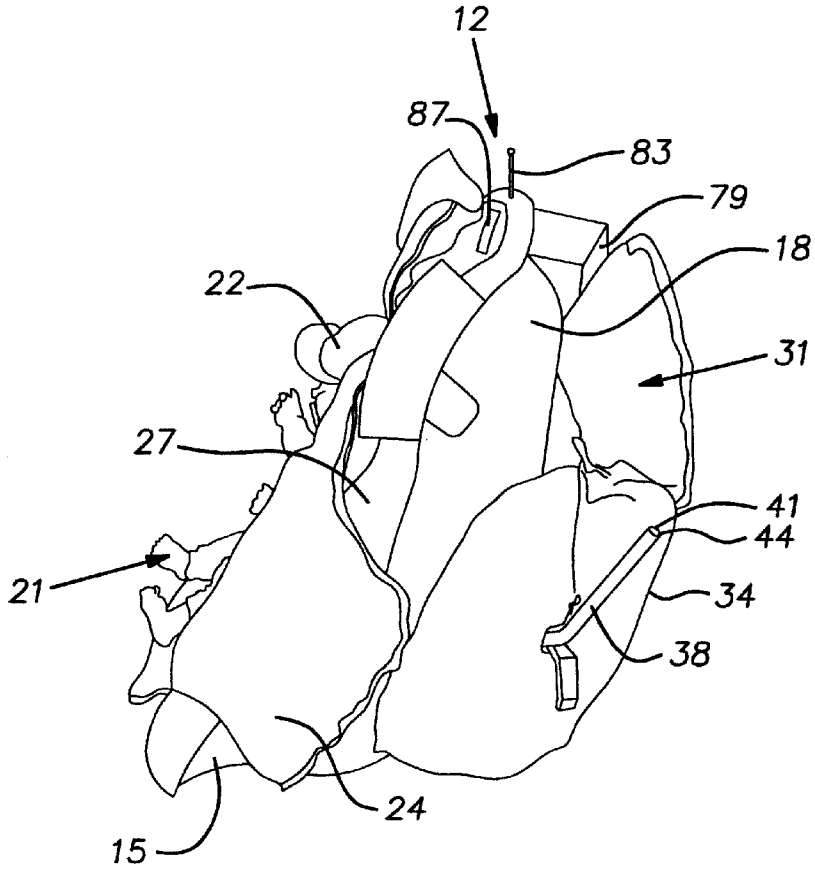
FIG. 3 is a side view of an example arrangement of a child seat assembly in accordance with the present invention having a child secured thereto and having an inflatable floatation device inflated.

As shown best in FIGS. 2 and 3, the seat 12 includes a floatation device 31 to float the child 21 when in the water such that the child's head 22 is above the water level. In this floating position, the child's 21 breathing is not obstructed by a volume of standing water as it would be if the child 21 was submerged below the water level. The floatation device 31 can be located at any position on the seat 12 to provide sufficient buoyancy and stability to the child 21 when floating. As pictured, the floatation device 31 is attached to the rear portion 18 of the seat 12. The floatation device 31 can be formed from any material or device capable of providing sufficient buoyancy to float the child 21 as described above. Known low-density plastics, typically having a foam-like structure include rigid buoyant materials such as closed-cell polypropylene or closed-cell polyethylene foam, or a low-density material such as closed-cell polyurethane or polystyrene encased within a water-resistant jacket are examples of devices that can be used in the floatation device 31. So-called soft buoyant materials can also be used with the floatation device 31 and include soft foams such as those commonly sold under the trademarks "ENSOLITE" and "AIREX". Similarly, the floatation device 31 can include an inflated bladder or an inflatable bladder 34 that retains a quantity of gas (not shown) to provide sufficient buoyancy to float the child 21 at least partially above the water. Further, the floatation device 31 may include a plurality of bladders 34 positioned to provide the child 21 with sufficient buoyancy to float the child 21 at least partially above the water.

According to the example embodiment shown in FIGS. 2 and 3, the floatation device 31 includes an inflatable bladder 34 made from a flexible material. Upon receiving a signal from an immersion sensor (not shown), described in greater detail below, the bladder 34 is automatically inflated to a suitable floating pressure. A conventional inflation cartridge (not shown) can be used to provide gas for inflating the bladder 34. Inflation cartridges are known devices that, for example, include reactive components isolated from each other within the cartridge that are combined upon activation of the cartridge. Other inflation cartridges can include a reactive component that produces a gas when combined with air or other ambient environment. Regardless of the nature of the reaction that takes place, gas produced as a product of the reaction that occurs is allowed to escape from the cartridge into the bladder 34 to inflate the bladder 34 in rapid fashion. The rapid inflation of the bladder 34 is sufficiently fast in a release situation to float the child 21 before the child's head 22 is submerged below the surface of the water or to surface the child quickly to prevent drowning in the even that submersion cannot be avoided. The gas used to fill the bladder 34 should be generally inert and not harmful to the environment and those exposed to it when it is eventually released from the bladder 34. Carbon dioxide is an example of a known gas produced for such inflation applications, however, other gases are also contemplated by the present invention.

As an alternative to inflating the bladder 34 with the inflation cartridge in response to the signal, the bladder 34 may further include an inflation tube 38 to allow the bladder 34 to be inflated manually. The inflation tube 38 includes an external open end 41 and an internal open end (not shown) and a generally tubular interior passage 44 therebetween to allow air to be directed into the bladder 34. When manual inflation of the bladder 34 is desired, air is blown through the external open end 41 generally toward the interior of the bladder 34. Air can be blown by the user with his mouth over an end of the inflation tube 38, or air can be supplied into the bladder 34 by an external source of air at an elevated pressure such as an air compressor or an air tank, for example.

When deflation of the inflatable floatation device 31 is desired, an aperture (not shown) is opened to create a passage through which the gas within the bladder 34 can escape. A control device (not shown) such as a valve can be provided to regulate the flow of air into and/or out of the bladder 34. The control device closes the aperture to prevent the gas from escaping the bladder 34 until the release of the gas is desired, and can be adjusted to open the aperture when deflation of the bladder 34 is desired.

The base 14 is a generally rigid structure that is to be fixed to a fixture of the watercraft, such as a chair, bench, deck, or any other object that is secured to, or forms part of the watercraft itself. Fixing the base 14 to the fixture is accomplished by using fasteners such as adjustable straps and clips (not shown). The straps may be permanently secured to the base 14, or alternatively, separate straps, such as a seat belt, can be secured to the base 14 by passing them through hoops or other connecting means provided on the base 14. The straps can also be separate from both the watercraft and the base 14. Alternatively, the base 14 could be formed as part of or be permanently secured to the fixture of the watercraft.

Figure 4:
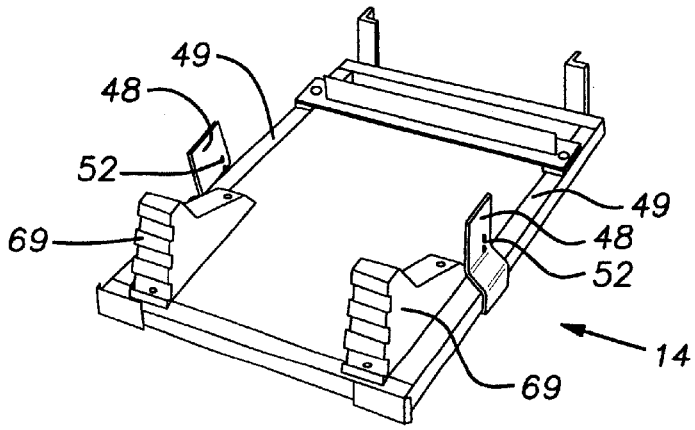
FIG. 4 is a perspective view of an example arrangement of a base in accordance with the present invention.

As best shown in FIG. 4, a bracket 48 extends generally vertically at two opposing sides 49 of the base 14. Each bracket 48 includes a fastening feature 52 that is compatibly located to cooperate with the release mechanism 11 provided adjacent to the opposite sides 26 of the bottom portion 15 of the seat 12. In the example embodiment illustrated in FIGS. 4–6, the fastening feature 52 of each bracket 48 is an aperture adapted to accept a rod 56 that forms a portion of the release mechanism. While the example embodiment described above and shown in the figures includes a base 14 having brackets 48 with a fastening feature 52 adapted to receive a rod 56 protruding from the seat 12, the scope of the present invention also includes a fastening feature 52 disposed on the seat 12 and a compatibly positioned release mechanism 11 on the base 14. Further, other cooperating release mechanisms could be used to connect the seat 12 and base 14.

In the example embodiment, the release mechanisms 11 on the bottom portion 15 of the seat 12 each include a rod 56 biased by a spring 57 (FIG. 6) in an inward direction. A sufficient force applied to the rod 56 in a generally outward direction can overcome the biasing force applied by the spring 57 to axially extend the rod 56. When extended a portion of the rod 56 protrudes beyond a frame structure 58 disposed adjacent to the release mechanisms 11 to guide the extension of the rod 56. When extended, the extended portion of the rod 56 further extends through its respective fastening feature 52 provided in the bracket 48 when the seat 12 is coupled to the base 14. The portion of the rod 56 protruding beyond the bracket 48 includes a passage 59 through which a pin 62 is to be inserted to prevent the rod 56 from returning to a biased position under the force of the spring 57. The pin 62 to be inserted in each rod 56 is adapted to be automatically removed upon the occurrence of a release situation, allowing the rods 56 to be automatically returned to the biased position where the rods 56 no longer protrude beyond the brackets 48 and the seat 12, if present, is released from the base 14.

According to the example embodiment, a cord 66 operatively connects the pin 62 to the inflatable bladder 34. As the bladder 34 is inflated in a release situation, it expands to accommodate the volume of gas provided by the inflation cartridge. This expansion causes the point where the cord 66 is connected to the bladder 34 to be displaced, and accordingly, pulls the pin 62 from its respective passage 59 formed in the rod 56. As explained above, upon removal of the pin 62, the rod 56 is returned to its biased position by the spring 57 and no longer protrudes beyond the bracket 48 of the base 14, thereby releasing the seat 12 from the base 14. Alternatively, a separate immersion sensor could be provided for releasing the seat 12 independently of the floatation device 31.

It is to be understood that the scope of the present invention also includes a system of releasing a seat 12 from a base 14 secured to a watercraft using a single, spring-biased release mechanism 11 instead of the plurality of release mechanisms 11 described above. In such a case, the release mechanism 11 may be provided at a central location under the bottom portion 15 of the seat 12, for example. And just as before, the release mechanism 11 and a bracket 48 with a compatible fastening feature 52 are interchangeably located on the base 14 and the seat 12. Accordingly, one of the release mechanism 11 and the bracket 48 are provided on the base 14, and the other is provided on the seat 12. Further, the release system 10 described above can include a plurality of release mechanisms 11 operatively connected to each other such that in a release situation, removal of a single pin 62 from a passage 59 can acuate a release of the seat 12 from the base 14.

The scope of the present invention also includes other arrangements of automatically releasing the seat 12 from the fixture of the watercraft upon the occurrence of a release situation. Examples of such systems include a release system having a destructible member, the integrity of which is destroyed or sufficiently degraded to allow the seat 12 to be released when exposed to water, or a member that is explosively destroyed by an explosive charge upon the transmission of the release signal by the immersion sensor for example. These, and other automatic release systems not specifically enumerated herein are included within the scope of the present invention. However, to clearly illustrate the present invention, the example embodiment employing the pin 62 operatively connected to the bladder 34 is described in detail herein.

The immersion sensor is a known device produced by manufacturers such as the McClintock Manufacturing Corporation, for example, that detects the presence of water in contact with the immersion sensor. The immersion sensor can be located at any location such that it detects the immersion of a portion of the seat 12 beneath the water level. A release signal is transmitted in response to water in contact with the seat 12 as detected by the immersion sensor. According to the example embodiment, the release signal activates the inflation of the bladder 34 and in turn, the automatic release of the seat 12 from the base 14.

Further, the system 10 may include a ballast device 71 (FIG. 2) attached to an appropriate location, such as under the seating surface 36 of the seat 12, for example, to ensure that the seat 12 maintains a generally upright position when floating in the water with a child 21 secured to the seat 12. In the generally upright position, a portion of the seat is submerged beneath the water level while the head 22 of the child is maintained above the water level. The child can breath with minimal interference from the water in the generally upright orientation. Any known ballast material can be used as appropriate, such as solid metal weights, metal shot, or the like.

The system 10 may also include a stabilizing system for stabilizing the seat 12 while attached to the watercraft and for absorbing or dampening incidental vibrations and other movements, such as those caused by the waves and other turbulence encountered by the watercraft. The stabilizing system may comprise any suitable stabilizing means 69 (FIG. 4), for example, shock absorbing members such as springs, elastically deformable members, hydraulic or pneumatic cylinders, and the like, attached to the seat 12 and/or the base 14. During operation of the watercraft to which the child 21 is secured using the seat 12, the stabilizing means elastically deform or adjust to dissipate a portion of the forces generated as a result of choppy, or turbulent water, for example. Due to this elastic deformation, the child 21 experiences a stabilized ride while secured to the seat 12 even during operation of the watercraft in turbulent water. Further, the stabilizing means 69 minimize the potential for injury to the child 21 from sudden changes in direction. As with conventional child safety seats, the seat 12 also comprises a restraint 73, such as a five-point shoulder strap for example, to secure a child 21 to the seat 12. Other features typically available as part of a child safety seat are optionally included as part of the present invention. Examples of such features include an adjustable headrest, a seat 12 adjustment, and a retractable canopy to shield a child 21 secured to the seat 12 from direct sunlight.

To maximize the chances of being discovered when a release situation occurs a considerable distance from land at a remote location, the seat 12 may also include visual aids 75 that tend to assist efforts to locate the child 21 in the seat 12. The visual aids 75 include any device or material that makes the seat 12 stand out from its surrounds such as reflective tape, highly-reflective objects, and other coloration for added visibility. An additional survival gear box 79 may also be provided on the seat 12 to include items such as a whistle, a signal mirror, a distress flag, phosphorescent light sticks for signaling nearby boaters, flares and the like. The survival gear box 79 can be mounted to a portion of the seat 12 or integrally formed as part of the seat 12 to be used by adults that are separated from the watercraft along with the seat 12. Further, the seat 12 may also include items such as an "Emergency Position Indicating Radio Beacon" (EPIRB) 83 and a personal floatation device (PFD) included within the survival gear box 79 to be detached and worn by an accompanying adult. Generally, the scope of the present invention encompasses the inclusion of any known device that can help searchers locate and recover the seat 12 and any accompanying adults having been separated from the watercraft.

Once the seat 12 is found floating in the water it can be easily retrieved by an occupant of a recovery vehicle by grasping a handle 87 suitably positioned to extend above the uppermost portion of the rear portion 18, for example. The handle 87 is suitably located to lift the seat 12 and child 21 out of the water without ejecting the child 21 from the seat 12, and can be retractable into the rear portion 18 of the seat 12.

Figure 5:
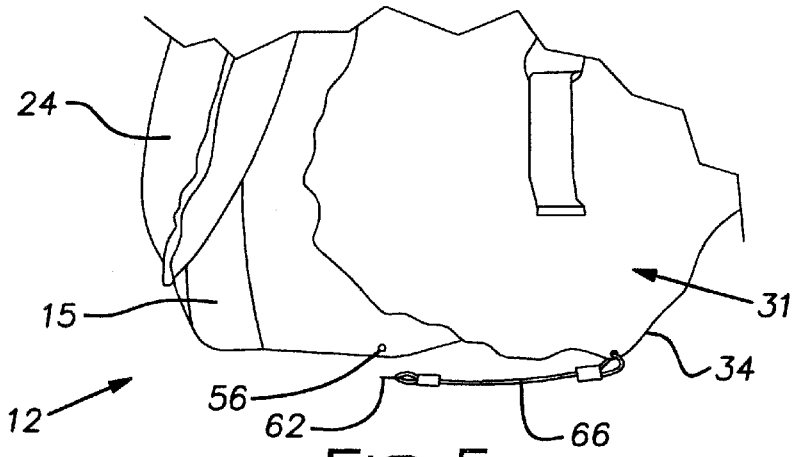
FIG. 5 is a side view of a portion of an example arrangement of a child seat assembly in accordance with the present invention wherein a pin is operatively connected to an inflatable floatation device in an inflated state.
Figure 5A:
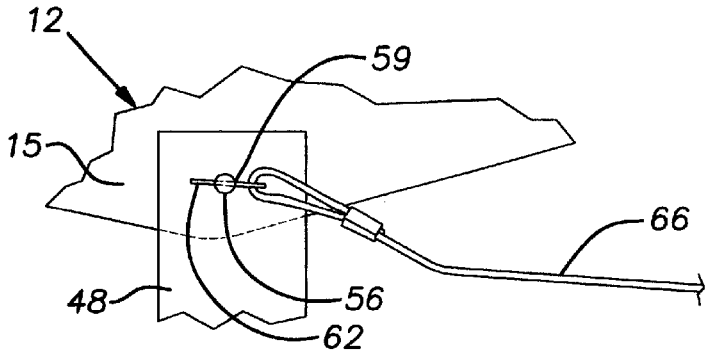
FIG. 5A is an enlarged perspective view of a portion of an example arrangement of a seat assembly in accordance with the present invention wherein a pin is inserted to maintain a rod in an extended position.
Figure 6:
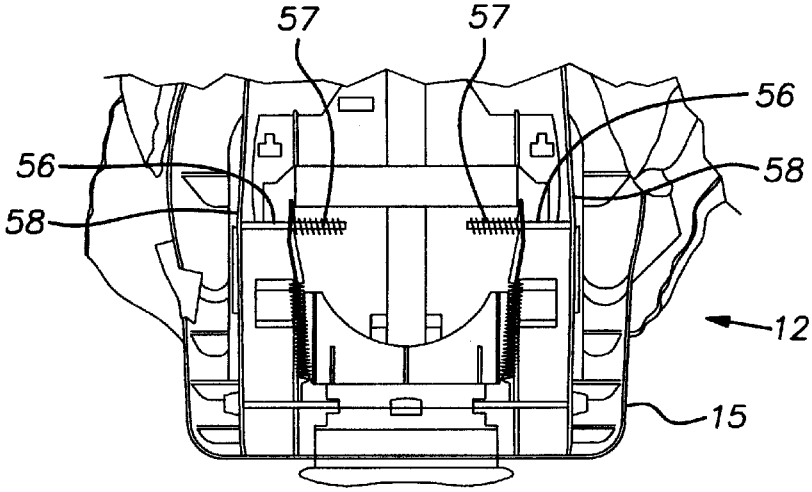
FIG. 6 is a bottom view of a portion of an example arrangement of a seat assembly in accordance with the present invention.

In normal use, the base 14 is secured to the fixture of the watercraft in a conventional manner and can be left secured thereto, allowing for easy attachment and removal of the seat 12. As best shown in FIGS. 4–6, the seat 12 attaches or "snaps in" to the base 14 by way of engagement between the brackets 48 on the base 14 and the corresponding release mechanisms 11 on the seat 12. The seat 12 is lowered in a generally vertical direction into the base 14 such that the release mechanisms 11 are concentrically aligned with the fastening feature 52 in their respective brackets 48. Once the seat 12 is in place, the rods 56 are extended such that they protrude outwardly beyond the brackets 48 such that the passages 59 in the rods 56 are external of the brackets 48. The pin 62 on each side of the bladder 34 is inserted into its respective passage 59, thereby preventing the rods 56 from returning to the biased position internal of the brackets 48. With the pin 62 in place, the rods 56 cooperate with the brackets 48 to releasably couple the seat 12 to the base 14 while the springs 57 impart the biasing force on the rods 56.

To manually remove the seat 12 from the base 14 in a non-release situation, an adult user manually removes the pins 62 from the passages 59 through the rods 56, allowing the rods 56 to return to the biased position. With the rods 56 in their biased position, the seat 12 can then be lifted away from the base 14. Other means of manually attaching and releasing the seat 12 from the base 14 may be used, such as a quick release mechanism known in the art.

In a release situation, the immersion sensor detects that a portion of the seat 12 is immersed in the water. As a result, the immersion sensor transmits the release signal to initiate inflation of the bladder 34, causing the bladder 34 to expand. Expansion of the bladder 34 pulls the cords 66 connected between the pins 62 and the bladder 34, and in turn, pulls the pin 62 from the passages 59 in the rods 56. With the pins 62 removed from the passages 59, the springs 57 return the rods 56 to the biased position, allowing the seat 12 to be freely removed from between the brackets 48 to float at least partially above the water. Due to the ballast device 71 the floating seat 12 is maintained in the generally upright orientation, allowing a child 21 secured to the seat 12 to breath without interference from the water.

Although the present invention has been described herein for use with a also within the scope of the present invention to install the base 14 in a car in manner to allow for the easy transition of the seat 12 from an automobile to and vice versa.

It should be evident that this disclosure is by way of example and that various made by adding, modifying or eliminating details without departing from the fair scope of the teaching contained in this disclosure.

What is claimed is:

1. A child seat to be coupled to a fixture of a watercraft for securing a child to the watercraft, the seat comprising:

a bottom portion and a rear portion shaped to support a child in a seated position;

a restraint for securing the child to the seat;

a release mechanism for automatically releasing the child from the fixture when a portion of the seat is immersed in water;

a floatation device to float the child at least partially above the water when the child is released from the fixture such that the head of the child is maintained above the water; and the floatation device comprising an inflatable bladder inflated by a gas when the portion of the seat is immersed in the water.

2. The child seat according to claim 1 further comprising an immersion sensor for detecting the immersion of the portion of the seat in the water and transmitting a signal to the release mechanism upon detecting said immersion.

3. The child seat according to claim 1 further comprising a ballast device for maintaining the seat assembly in a generally upright orientation when the seat assembly is floating in the water such that the bead of the child is maintained above the water.

4. The child seat according to claim 1, wherein the gas is carbon dioxide.

5. The child seat according to claim 1, further comprising a base having a bracket, the bracket comprising an aperture for cooperation with the release mechanism for releasably coupling the seat to the fixture.

6. The child seat according to claim 5 further comprising a pin operatively connected to the bladder in a manner such that inflation of the bladder causes displacement of the pin relative to the release mechanism, thereby releasing the seat from the base.

7. The child seat according to claim 1 further comprising padding on portions of the seat for comforting the child while secured to the seat.

8. The child seat according to claim 7, wherein the padding comprises a buoyant material.

9. The child seat according to claim 8, wherein the buoyant material comprises a natural fiber enclosed in a water resistant cover.

10. The child seat according to claim 1 further comprising a handle to facilitate removal of the seat from the water.

11. The child seat according to claim 1, wherein the restraint comprises a five-point harness sizeable to secure a child in the seat.

12. The child seat according to claim 1 further comprising a retractable canopy to shield the child from direct sunlight while the child is secured to the seat.

13. The child seat according to claim 1, wherein an angle between the bottom portion and the rear portion is adjustable.

14. The child seat according to claim 1 further comprising one or more members of a group consisting of a noise producing device, a light reflecting material, an illuminating device, a visual notification device, a radio transmitter, and a personal floatation device.

15. A child restraint system for securing a child aboard a watercraft, the restraint system comprising:

a seat assembly including a restraint to secure the child to the seat assembly, wherein the seat assembly is adapted to be releasably coupled to a fixture of the watercraft;

an immersion sensor for detecting the immersion of a portion of the seat assembly in water and transmitting a signal upon detecting the immersion; and an inflatable floatation device operatively connected to the seat assembly such that the floatation device is automatically inflated to float the seat assembly at least partially above the water in response to the transmission of the signal;

a ballast device for maintaining the seat assembly in a generally upright orientation when the seat assembly is floating in the water such that the head of the child is maintained above the water.

16. The child restraint system according to claim 15 further comprising a base to be secured to the fixture and to releasably couple the seat assembly to the fixture, the base comprising a rigid frame having a connecting bracket to cooperate with a connecting feature of the seat assembly to releasably couple the seat to the base.

17. The child restraint system according to claim 16 further comprising a release mechanism that releases the seat from the base when the floatation device inflates.

18. The child restraint system according to claim 17, wherein the release mechanism comprises a pin operatively connected to the floatation device by a chord, the pin extending through a passage formed in a rod of the release mechanism when the rod is extended to protrude beyond the bracket, thereby coupling the seat to the base, further wherein the pin is pulled by the cable from the passage upon inflation of the floatation device.

19. The child restraint system according to claim 15 further comprising a ballast device for maintaining the seat assembly in a generally upright orientation when the seat assembly is floating in the water such that the head of the child is maintained above the water.

20. The child restraint system according to claim 15 further comprising a release mechanism that releases the seat from the fixture when the floatation device inflates.

21. The child restraint system according to claim 15, wherein the floatation device comprises a bladder that is automatically inflated by a gas.

22. The child restraint system according to claim 21, wherein the gas is carbon dioxide.

23. The child restraint system according to claim 15, wherein the floatation device is attached to an upright rear portion of the seat assembly such that the floatation device orients the seat assembly generally upright when the floatation device is inflated and the seat assembly is floating in water.

24. The child restraint system according to claim 15 further comprising padding provided on a surface of the seat assembly that contacts the child when the child is secured to the seat, wherein the padding comprises a buoyant material.

25. The child restraint system according to claim 15 further comprising one or more members of a group consisting of a noise producing device, light reflecting material, illuminating device, a visual notification device, a radio transmitter, and a personal floatation device.

26. A child restraint system for securing a child aboard a watercraft, the child restraint system comprising:

a base adapted to be secured to a fixture of the watercraft;

a seat assembly adapted to be releasably coupled to the base in a manner to support the child in a seated position;

a restraint for securing the child to the seat assembly;

a release mechanism that cooperates with the base and the seat assembly when the seat assembly is coupled to the base; and a floatation device for floating the child in water such that the head of the child is maintained above a surface of the water, the floatation device comprising an inflatable bladder that is automatically inflated with a gas when the portion of the seat assembly is immersed in the water, wherein the release mechanism automatically releases the child from the watercraft when a portion of the seat assembly is immersed in the water.

27. The child seat according to claim 26, wherein the gas is carbon dioxide.

28. The child restraint system according to claim 26 further comprising a ballast device to float the child in a generally upright orientation with the head of the child above the water.

29. The child restraint system according to claim 26 further comprising an immersion sensor for detecting the immersion of the portion of the seat assembly in water and transmitting a signal upon said detection.

30. The child restraint system according to claim 26 further comprising padding provided on a surface of the seat assembly that contacts the child when the child is secured to the seat, wherein the padding comprises a buoyant material.

31. The child restraint system according to claim 26 further comprising one or more members of a group consisting of a noise producing device, light reflecting material, illuminating device, a visual notification device, a radio transmitter, and a personal floatation device.

* * * * *

UNITED STATES PATENT AND TRADEMARK OFFICE

CERTIFICATE OF CORRECTION

PATENT NO. : 6,715,830 B2
DATED : April 6, 2004
INVENTOR(S) : Grayson L. Alexy

It is certified that error appears in the above-identified patent and that said Letters Patent is hereby corrected as shown below:

Title page,
Item [60], Related U.S. Application Data, please delete "60/430,923", and insert therefor -- 60/430,903 --.

Column 8,
Line 54, after "for use with a", please insert -- watercraft, it is --.
Line 55, after "in a car in", please insert -- a conventional --.
Line 56, after "from an automobile to" please insert -- the watercraft, --.
Line 59, after "and that various", please insert -- changes may be --.

Signed and Sealed this

Fifth Day of October, 2004

JON W. DUDAS
*Director of the United States Patent and Trademark Office*